United States Patent [19]

Kornrumpf

[11] 4,392,171

[45] Jul. 5, 1983

[54] POWER RELAY WITH ASSISTED COMMUTATION

[75] Inventor: William P. Kornrumpf, Albany, N.Y.

[73] Assignee: General Electric Company, Schenectady, N.Y.

[21] Appl. No.: 299,763

[22] Filed: Sep. 8, 1981

[51] Int. Cl.[3] ..... H01H 33/59

[52] U.S. Cl. ..... 361/5; 361/13

[58] Field of Search ..... 361/5, 7, 13; 307/134

[56] References Cited

U.S. PATENT DOCUMENTS

| | | | |
|---|---|---|---|
| 3,372,303 | 3/1968 | Knott | 361/13 |
| 3,474,293 | 10/1969 | Siwko et al. | 361/13 |
| 3,555,353 | 1/1971 | Casson | 361/13 |
| 3,675,079 | 7/1972 | Labbaye et al. | 361/5 X |
| 4,074,333 | 2/1978 | Murakami et al. | 361/13 |

*Primary Examiner*—Harry E. Moose, Jr.

*Attorney, Agent, or Firm*—Geoffrey H. Krauss; James C. Davis, Jr.; Marvin Snyder

[57] ABSTRACT

The contacts of a power relay are shunted by a gateable semiconductor device to assist in the commutation of contact-destroying arcs upon making and breaking of the power relay contacts; current-detection apparatus, such as a current-sensing transformer and the like, are utilized in the conductors connecting the relay contacts and the gateable switching device to an input from an A.C. source. Control electronics receive the outputs of both current-sensing apparatus to gate the shunting device into conduction during relay contact closure and separation, in a manner to minimize the current passing through the shunting device and therefore to minimize the energy dissipated therein.

10 Claims, 4 Drawing Figures

POWER RELAY WITH ASSISTED COMMUTATION

BACKGROUND OF THE INVENTION

The present invention relates to apparatus for controlling the application of power to a load and, more specifically, to a novel assisted-commutation power relay, in which the current conducted through, and energy dissipated in, a contact-shunting device is minimized.

It is now well-known that relay contact damage, caused by arcing and the like phenomena normally occurring during making and breaking of a current-carrying contact between a source and a load, can be substantially reduced or eliminated by providing an element in parallel with the relay contacts, and controlling the shunting element to conduct while the relay contacts are actually being opened and closed. Apparatus using a controllably conducting semiconductor device across the relay contacts, is found in such prior art descriptions as U.S. Pat. Nos. 3,474,293 to Siwko et al.; 3,555,353 to Casson; and 3,868,549 to Schaefer et al., amongst others. These early apparatus may be considered as "brute force" approaches to the relay contact damage problem, and typically require shunting semiconductor devices capable of withstanding relatively high current and power dissipation. In U.S. Pat. No. 4,074,333 to Murakami, et al., and the like, conduction in the shunting semiconductor device is enabled for relatively fixed time intervals, in an attempt to reduce the energy dissipation of the shunting device. However, the current handling capability of such shunting solid-state switches, in parallel with the relay contacts, must be sufficiently high to conduct the full load current of the power relay apparatus for a relatively large number of cycles of the power line frequency. Because of the resulting current-time rating, the solid-state switch is relatively large and expensive, and generally requires a bulky heat sink to adequately protect the solid-state switch from over-temperature conditions, particularly when the apparatus is utilized with certain loads, such as motors which may have the rotor thereof locked at the time that motor starting may be commanded. Relatively long conduction time periods also occur due to the relatively long pull-in and drop-out times found in power relays utilized for controlling relatively large motors and the like. The pull-in time has a relatively large spread due to the A.C. coil having different characteristics dependent upon when, in a source waveform half-cycle, that coil is energized; if the coil is energized while the line voltage is at a peak, the relay contacts pull in much more rapidly than if the power relay is energized at a line voltage minimum, e.g. close to a line voltage waveform zero crossing. Friction and damping effects of structures utilized for modern power relays also introduce a variability in the pull-in time of the power relay. Similar large time spreads are found in the drop-out characteristics of power relays. Therefore, the shunting solid-state switch must continue to carry load current, when the relay is commanded to its open condition, on the possibility that a particular relay may be slow enough to require a longer period to drop out thn another relay of the same type. Accordingly, power relay apparatus which will minimize the current rating, conduction time and energy dissipation of the shunting solid-state switching device, is highly desirable.

BRIEF SUMMARY OF THE INVENTION

In accordance with the invention, a controllably conductive device is connected in shunt with the contacts of a power relay, between a power source and a power-consuming load; current-sensing means, such as a transformer and the like, are utilized for sensing the current flowing from the source through each of the power relay contacts and the shunting device; and control means, receiving a pair of signals, each indicative of the current instantaneous flowing to the load through one of the power relay contacts and the shunting device, provides a gating signal for turning on the controlled conduction device for conducting load current therethrough essentially only when the power relay contacts bounce during closure, and substantially only for a time interval sufficient for the power relay contacts to sufficiently separate such that an arc cannot occur therebetween, on contact separation.

In one presently preferred embodiment, the gateable conduction device is a triac and the current-sensing means are toroidal transformers having single turn primary windings which are the current-carrying conductors, between the power source and the power relay contact and conduction device, themselves. The current transformers provide center-tapped secondary windings, and the control means includes a pair of full-wave rectifiers coupled to the associated transformers secondary windings to provide first and second current transformer output voltages to logic circuitry. The logic circuitry receives a control voltage, present whenever the power relay coil is energized, to gate the shunting device into conduction when pulses of current are detected by the current transformer in series with the power relay contacts, during the bouncing thereof upon closure, and during a fixed time interval, established by a multivibrator triggered in part by the voltage from the remaining rectifier, during turn-off of the assisted-commutation power relay apparatus. The apparatus may be utilized for controlling the application and removal of multi-phase power to a load.

Accordingly, it is an object of the present invention to provide a power relay with assisted commutation in which the amount of time that the assisted commutation device is conducting current therethrough is minimized.

This and other objects of the present invention will become apparent upon consideration of the following detailed description, when read in conjunction with the drawings.

DETAILED DESCRIPTION OF THE INVENTION

Figure 1:
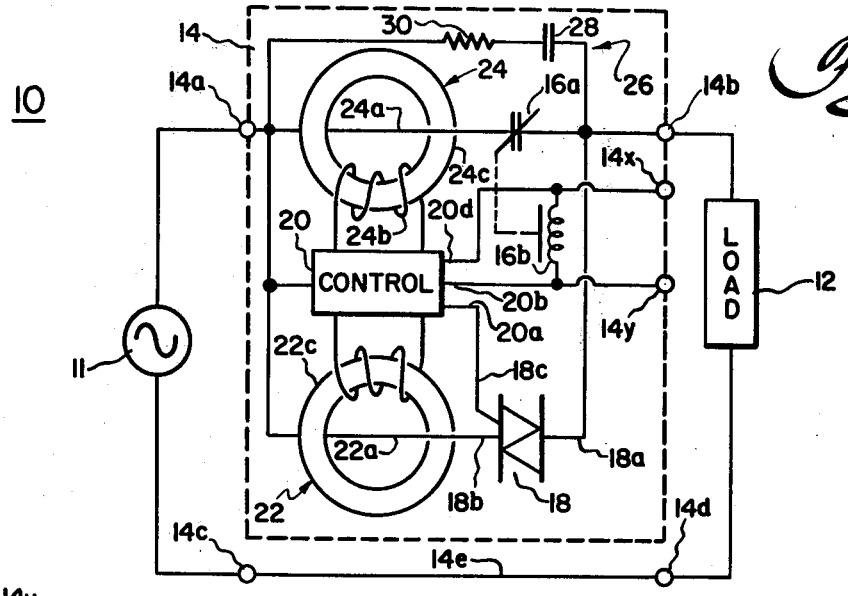
FIG. 1 is a schematic block diagram of the novel assisted commutation power relay of the present invention, in use between a source and a control load.
Figure 1A:
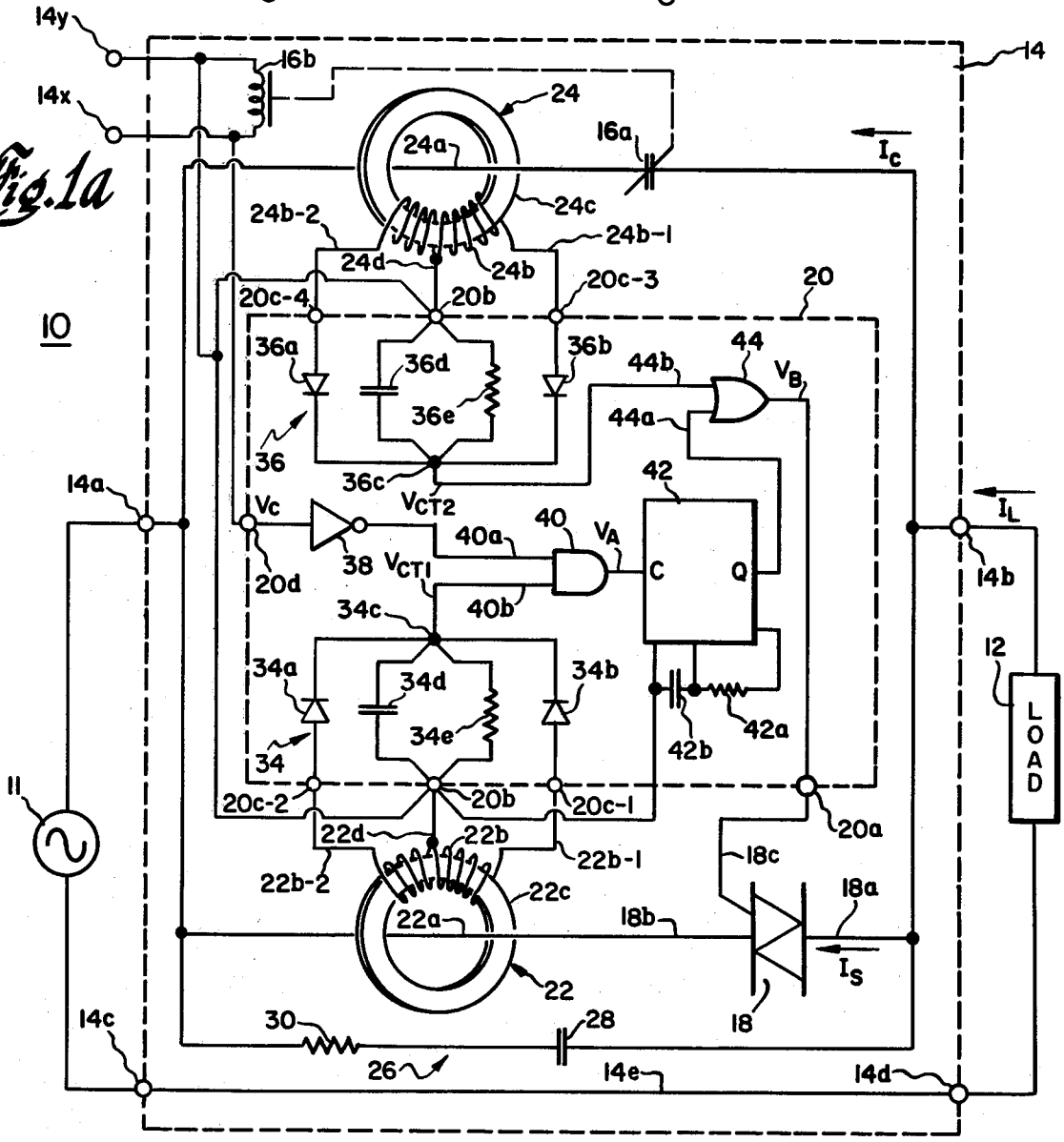
FIG. 1*a* is a more detailed schematic diagram of one embodiment of the assisted commutation power relay of the present invention.
Figure 1B:
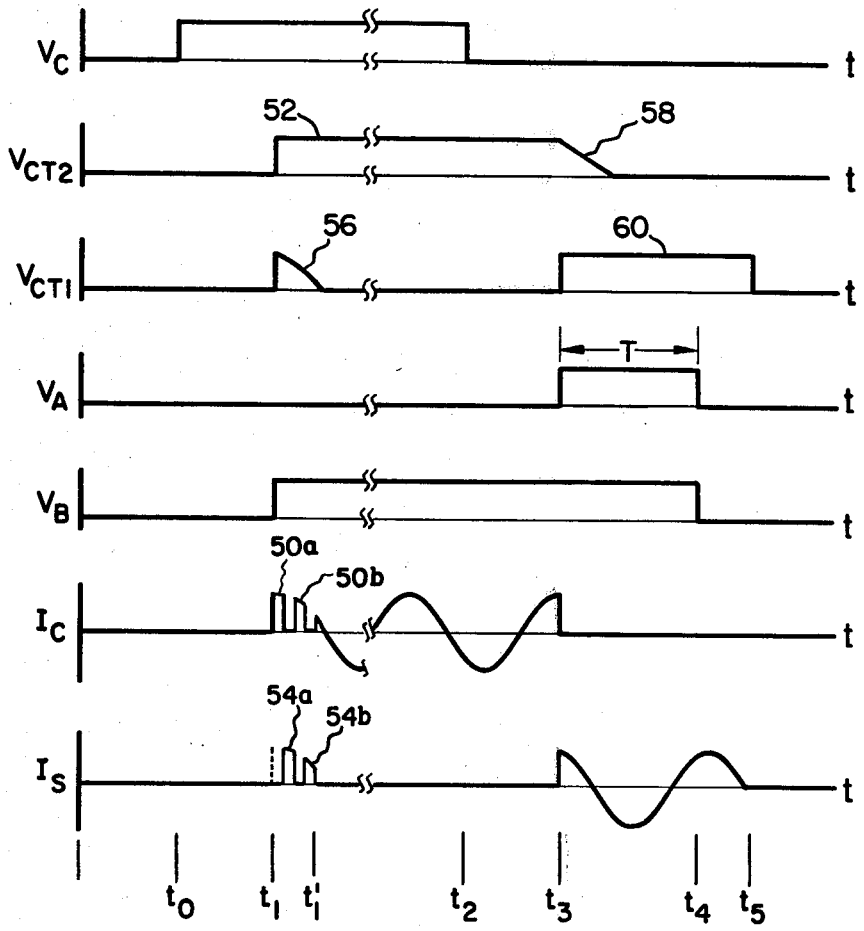
FIG. 1*b* is a set of interrelated graphs illustrating the various voltage and current waveforms in the circuit of FIG. 1*a*, and useful in understanding the operation of the present invention.

Referring initially to FIGS. 1, 1*a* and 1*b*, a power utilization system 10 includes an A.C. source 11 which is controllably connected across a power-consuming load 12 by a selectively actuated power relay means 14. In the illustrated embodiment, source 11 is a single-phase source and load 12 is a single-phase load, whereby power relay means 14 is a single-phase power relay apparatus. Power relay means 14 includes an input terminal 14*a* connected to one terminal of source 11, an output terminal 14*b* connected to one terminal of load 12, and second conductor terminals 14*c* (connected to the remaining terminal of source 11) and 14*d* (connected to the remaining terminal of load 12), which are illustratively connected together by conductor 14*e*. For the purposes of explanation, the single-phase source 11 terminal connected to, and through, apparatus terminals 14*c* and 14*d* is the neutral conductor, while the conductor connected to terminal 14*a* is the "hot" conductor.

Power relay means 14 completes the connection between hot input terminal 14*a* and load output terminal 14*b* responsive to the presence of a control potential between active control terminal 14*x* and common control terminal 14*y*. Thus, when a control potential of a suitable characteristic appears between terminals 14*x* and 14*y*, a highly conductive path is to be provided between terminals 14*a* and 14*b*; when the control potential is removed from between terminals 14*x* and 14*y*, an essentially open-circuited path is to appear between terminals 14*a* and 14*b*, whereby the load does not draw current from source 11.

Power relay means 14 includes a power relay 16 having the contacts 16*a* thereof in series between input terminal 14*a* and output terminal 14*b*. The contact-actuating coil 16*b* is, illustratively, connected between control terminals 14*x* and 14*y*. A commutating semiconductor switching device 18, such as a triac and the like, is connected in parallel with relay contacts 16. In the illustrated embodiment, wherein the device 18 is a triac, the anode and cathode electrodes 18*a* and 18*b*, respectively, thereof are connected across the relay contacts, while the control electrode 18*c* is connected to a control output 20*a* of a control means 20. A first current transformer 22 has a single-turn primary winding 22*a*, which may be the current-carrying lead between device 18 and input terminal 14*a*. First transformer 22 has a secondary winding 22*b* which is connected to control means 20. A second current transformer 24 includes a primary winding 24*a*, which may be a single-turn winding formed of the current-carrying conductor between relay contact 16*a* and input terminal 14*a*. Second transformer 24 has a secondary winding 24*b* also connected to control means 20. Advantageously, the first and second current transformers 22 and 24 are fabricated with toroidal cores 22*c* and 24*c*, respectively. A snubbing network 26 utilizes an energy storage element, such as a capacitance 28, in series with an energy-dissipating element, such a resistance 30, between input and output terminals 14*a* and 14*b*, respectively, and across the relay contact 16*a*.

In one presently preferred embodiment, as shown in FIG. 1*a*, the current transformer secondary windings 22*b* and 24*b* are multiturned, center-tapped windings having the center taps 22*d* and 24*d*, respectively, thereof connected to a control means common terminal 20*b* and having the secondary winding ends 22*b*-1 and 22*b*-2, or 24*b*-1 and 24*b*-2, respectively, connected to control means transformer input terminals 20*c*-1 through 20*c*-4, respectively.

In the illustrated embodiment, relay coil 16*b* is illustratively energized by the same control potential, e.g. a CMOS-logic compatible voltage, as utilized by the logic components (described hereinbelow) of control means 20. Accordingly, the control input common terminal 14*y* is connected not only to one end of relay coil 16*b*, but also to control means common terminal 20*b*. The control input active terminal 14*x* is connected to the other terminal of relay coil 16*b* and also to the control voltage $V_c$ input 20*d* of the control means.

Within one presently preferred embodiment of control means 20 (FIG. 1*a*) are a pair of rectifier means 34 and 36, respectively, each associated with one of the pair of current transformers. Thus, rectifier means 34 is associated with first current transformer 22 to provide a first D.C. voltage $V_{CT1}$ proportional to the magnitude of the voltage provided to control means 20 by the first current transformer secondary winding 22*b*, while rectifier means 36 provides a second D.C. voltage $V_{CT2}$ of magnitude responsive to the magnitude of the voltage provided by second current transformer secondary winding 24*b* to the control means. Each of first and second rectifier means 34 and 36 include a pair of rectifying elements, e.g. semiconductor diodes 34*a* and 34*b* or 36*a* and 36*b*, connected between an associated one of inputs 20*c*-1 through 20*c*-4 and an associated rectifier means output 34*c* or 36*c*. An output filter network, comprised of a capacitive element 34*d* and 36*d* and a load resistance 34*e* or 36*e*, is connected between rectifier means output 34*c* or 36*c* and control means common 20*b*. The rectifiers are poled to provide an output polarity of the associated voltages $V_{CT1}$ or $V_{CT2}$ as required for the particular type logic utilized in the control means. The logic includes an inverter 38 having an input connected to active control terminal 20*d* and an output connected to one input 40*a* of a two-input AND gate 40. The remaining gate input 40*b* is connected to the output 34*c* of that rectifier means 34 associated with the first current transformer 22 in series with the control semiconductor switching element 18. The output of gate 40 provides a first logic voltage $V_A$ to the control C input of a monostable, or one-shot, multivibrator means 42. A timing resistance 42*a* and a timing capacitance 42*b* are connected to the multivibrator 42, and suitable connection is made to control means common 20*b*, such that a pulse of a preselected time duration T is provided at a multivibrator Q output responsive to a trigger signal received at the C input. The multivibrator output is connected to one input 44*a* of a two-input OR gate 44, having its remaining input 44*b* connected to the output 36*c* of the second rectifier means. The gate 44 output signal $V_B$ is connected to the control means output 20*a* and thence to the solid-state switching element control electrode 18*c*. It should be understood that the operating potential and ground connections for logic elements 38, 40, 42 and 44 are not shown, for purposes of clarity, and that such connections and the methods of making same are well-known in the digital logic arts. It will also be understood that should relay 16 require a coil 16*b* having an operating voltage different that the voltage utilized between terminals 20*d* and 20*b* for actuating the logic of control means 20, other suitable connections may be effected between a plurality of input 14*x*, coil 16*b* and input 20*d*, to cause operating potential to be applied and removed simultaneously across both coil 16*b* and input 20*d*.

In operation, and referring specifically to FIGS. 1a and 1b, initially the absence of control potential between terminals 14x and 14y has, for the purposes of discussion, been of sufficiently long duration such that power relay contacts 16a are open and there is no flow of current from source 11 to load 12. Thus, the contact current $I_c$ and the switching semiconductor current $I_s$, as well as control voltage $V_c$, the pair of transformer-rectifier means output voltages $V_{CT1}$ and $V_{CT2}$, gate output voltage $V_A$ and gate output voltage $V_B$, are all of substantially zero magnitude. A control potential $V_c$ of sufficiently large magnitude appears at control terminal 14x, with respect to terminal 14y, at a time $t_0$. Illustratively, control voltage $V_c$ is of positive polarity and at a logic-one level. The power relay coil 16b is energized, but due to the mechanical inertia of contact 16a, the contacts do not close until some later time $t_1$. The closure of contacts 16 at time $t_1$ allows current $I_c$ to flow from source 11 to load 12. However, because of bouncing of contacts 16a, the contact current $I_c$ occurs as a series of pulses 50, e.g. pulses 50a and 50b, before the contacts are continuously closed at some time $t_1'$. The initial flow of contact current $I_c$, in pulse 50a, causes a voltage to appear across the second current transformer secondary winding 24b, which voltage is rectified by rectifier means 36 such that a non-zero-magnitude D.C. voltage 52, e.g. of positive polarity, appears at $V_{CT2}$ output 36c after time $t_1$. The turns ratio between second transformer primary winding 24a and secondary winding 24b is set such that the positive-polarity voltage is of a logic-one magnitude. This logic-one signal 52 appears at gate input 44b. Accordingly, gate 44 output voltage $V_B$ goes to a logic-one level and gates device 18 into conduction. Switching device current $I_s$ will begin to flow when contact 16a is opened, during bouncing. Thus, the current flows through the lower impedance of the contact when closed, e.g. pulses 50a and 50b, and flows through device 18, as pulses 54a and 54b for example, when contact 16a is open. Device 18 will remain conductive until the voltage thereacross is reduced to zero, at the end of that half-cycle of the A.C. waveform from source 11; illustratively this occurs at a time after time $t_1'$. The flow of semiconductor device current $I_s$, through first current transformer primay winding 22a, causes a voltage to appear across first transformer secondary winding 22b, which voltage is rectified in first rectifier means 34 and causes a non-zero-magnitude, e.g. positive-polarity, voltage $V_{CT1}$ to appear at gate input 40b. This voltage gradually decreases, as at portion 56, as the shunt current $I_s$ decreases and terminates, with the cessation of contact bounce, as the magnitude of first rectifier means filter capacitance 34d and resistance 34e are such that the voltage at the output 34c thereof decreases to a zero level after time $t_1'$, whereby the logic-zero gate output voltage $V_A$ level is maintained thereafter. Even though the voltage at gate input 40b is temporarily at a logic-one level, the voltage at remaining gate input 40a is at a logic-zero level (due to action of inverter 38 on the logic-one level present at $V_c$ input 40d). Therefore, the gate output voltage $V_A$ remains at a logic-zero level and one-shot multivibrator 42 is not triggered. The voltage at gate input 44a accordingly remains at a logic-zero level. Thus, contact closure generates a logic-one voltage level at gate input 44b and causes device 18 to conduct, in parallel with the relay contacts, causing current to be shunted around the bouncing relay contacts such that welding or other deleterious effects cannot occur at the relay contacts during closure. Conduction of shunting device 18 ceases when contacts 16a are firmly closed. Thereafter, and as long as the control voltage $V_c$ is in the relay-closed, e.g. logic-one, condition, due to the lower resistance in closed contact 16a load current flows through contact 16a, even though device 18 is gated on.

The assisted-commutation power relay is open-circuited by removal of the control potential $V_c$ from terminal 14x, as at time $t_2$. At that time, the first transformer-rectifier output voltage $V_{CT1}$ and the AND gate output voltage $V_A$ are in the logic-zero condition, while the second transformer-rectifier means output voltage $V_{CT2}$ and the OR gate output voltage $V_B$ are in the logic-one condition. After the removal of the control voltage, a finite time, e.g. until time $t_3$, is required for relay contact 16a to beging opening. Upon opening of contact 16a at time $t_3$, the current flow through second transformer primary winding 24a ceases, and the voltage across the secondary winding 24b thereof falls substantially to zero. The associated rectifier output voltage $V_{CT2}$ rapidly falls, as at portion 58, with a time constant established by the magnitude of capacitance 36d and resistance 36e. Therefore, immediately after time $t_3$, the semiconductor switch triggering voltage $V_B$ is still at a logic-one level and device 18 still conducts. Shortly after time $t_3$, the logic-one level at gate input 44b changes to a logic-zero level. At time $t_2$, when the control voltage magnitude has been reduced substantially to zero, the inversion thereof provides a logic-one level at AND gate input 40a.

During the time when contact 16a is closed, the lower resistance of the contacts cause substantially all of the load current $I_L$ to flow therethrough as contact current $I_c$, and the shunting device current $I_s$ was substantially zero. With the actual opening of contact 16a, at time $t_3$, current $I_c$ falls to zero, voltage $V_{CT2}$ decays toward zero, and the flow of load current is transferred to the shunting device, so that the current $I_s$ thereof abruptly increases. The increase in current flow through first transformer primary winding 22a causes the associated rectifier output voltage $V_{CT1}$ to increase and place a logic-one level signal 60 on the second AND gate input 40b. As both inputs of gate 40 are now at the logic-one level, the output voltage $V_A$ goes to the logic-one level. The rising voltage triggers multivibrator 42, causing the Q output thereof to go to the logic-one level for a time interval T established by the associated timing resistance 42a and capacitance 42b values. The logic-one output pulse is transmitted through gate 44 and appears as a logic-one gating voltage $V_B$. Therefore, even though the $V_{CT2}$ voltage decays, the shunting device 18 is continuously gated into the conductive condition for the multivibrator output pulse time interval T after contact opening time $t_3$. The load current $I_L$ continues to flow through shunting device 18 until the end of time interval T, at time $t_4$. At time $t_4$, the one-shot multivibrator times out and the gate voltage $V_B$ falls to the logic-zero level. Shunting device 18 continues to conduct until the next source waveform zero crossing, e.g. at time $t_5$, well after the main relay contact 16 has opened sufficiently to prevent arcing and other deleterious effects thereat. It will therefore be seen that the switching device 18 only conducts the load current present during contact bounce on contact closure and only conducts the load current for one-half of one source waveform cycle on contact opening. While the time interval T of the multivibrator may be set such that the switching device is gated into the conductive condition until the relay contacts are far enough apart so that they can sustain the line voltage without arcing, in the event that the relay contact opens very close to the end of a source waveform half-cycle, the energy dissipated in the switching device is still relatively low. Therefore, the use of the assisted commutation power relay 14 of the present invention is such that the amount of power dissipated in the switching device is relatively low.

Figure 2:
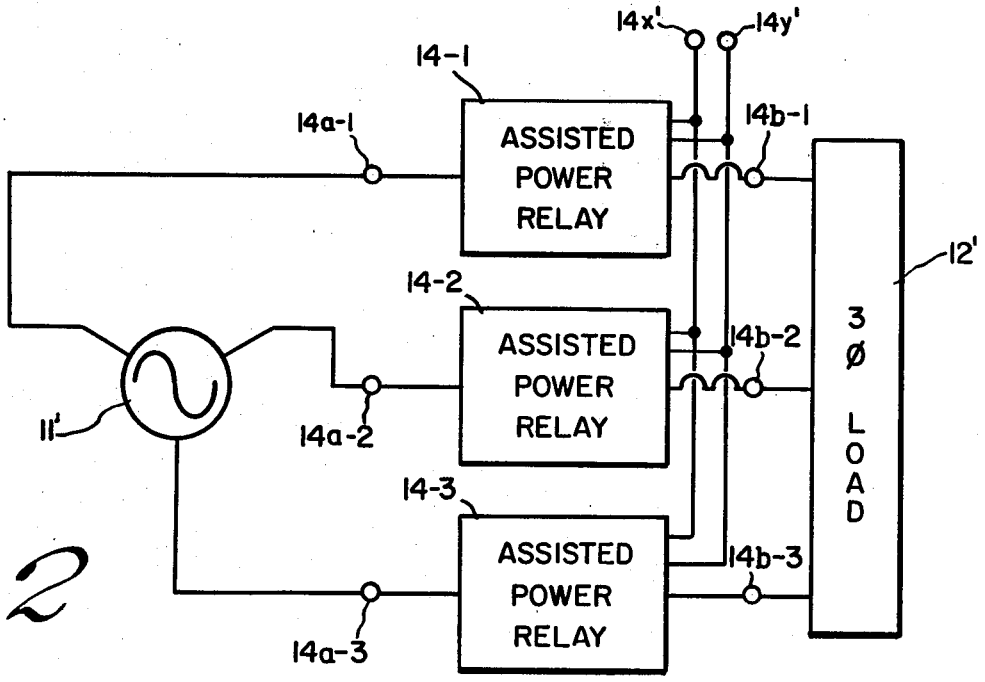
FIG. 2 is a block diagram illustrating the use of assisted commutation power relays for controlling power from a multi-phase source to a multi-phase load.

In a multi-phase source/load configuration, such as the three-phase Y configuration of FIG. 2, one assisted-commutation power relay, e.g. one of relays 14-1 through 14-3, is placed in each one of the plurality of power conductors between source 11' and load 12'. A common control input 14x', with reference to control common 14y', can be utilized, as the control means of each assisted relay will commutate the arcing current individually therein, for each of the phases. Insulation and safety requirements may dictate that additional isolation techniques, such as the use of optoelectronic isolators and the like, be used between the control potential inputs and the remainder of the circuitry of each relay, as necessary for the particular end use contemplated. Advantageous, the plurality of contacts of relay means 14-1 through 14-3 are part of a single electromechanic, multi-pole power relay means.

While one presently preferred embodiment of my novel assisted-commutation power relay has been described with some detail herein, many variations and modifications will now become apparent to those skilled in the art. For example, a pair of silicon-controlled rectifiers in reverse-parallel connection may be equally as well utilized as a triac and the like switching devices. It is my intent, therefore, to be limited only by the scope of the appending claims and not by the details of the embodiments selected for description herein.

What is claimed is:

1. Apparatus for forming a current-carrying connection between an A.C. source and a current-consuming load, responsive to a control signal, comprising:

power relay means for selectably completing and breaking a connection between said source and said load responsive to the respective presence and absence of said control signal;

means for providing a current-carrying path shunting said power relay means responsive to a gate signal; and means for sensing the flow of current through each of said power relay means and said current-carrying means to provide said gating signal both (a) at least upon commencement of current flow and (b) for at least one-half cycle of the source waveform after cessation of current flow through said power relay means, to prevent formation of an arc in said power relay means during both completing and breaking of said connection.

2. The apparatus of claim 1, wherein said current sensing means includes: first means for sensing the magnitude of current flowing through only said power relay means; second means for sensing the magnitude of current flowing through only said current-carrying means; and control means for providing said gate signal at least when said first means senses commencement of current flow upon completion of power relay means connection and also for providing said gate signal for at least one-half of the source waveform after said second means senses cessation of current flow upon breaking of said power relay means connection.

3. The apparatus of claim 2, wherein said first means includes a current transformer.

4. The apparatus of claim 3, wherein said second means includes a current transformer.

5. The apparatus of claim 4, wherein at least one of said current transformers includes a primary winding formed in series between said source and the associated one of said power relay means and said shunting means, and a secondary winding.

6. The apparatus of claim 5, further comprising rectifier means connected to said transformer secondary winding for providing a potential whenever a flow of current occurs through said transformer primary winding.

7. The apparatus of claim 4, wherein said first means current transformer inludes a primary winding formed between said source and said power relay means, and a secondary winding; said second means current transformer includes a primary winding formed between said source and said shunting means, and a secondary winding; and further comprising: first rectifier means connected to said first means current transformer secondary winding for providing a potential whenever a flow of current occurs through said first means current transformer primary winding; second rectifier means connected to said second means current transformer secondary winding for providing another potential whenever a flow of current occurs through said second means transformer primary winding; and said control means includes an AND gate having a first input receiving the potential from said second rectifier means, a second input receiving the inverse of said control signal and an output; a monostable multivibrator triggered whenever the output of said AND gate is at a first condition responsive to the presence of said second rectifier means potential and the inversion of said control signal, and having an output enabled for a predetermined time interval after the multivibrator is triggered; and an OR gate providing the gate signal to said shunting means responsive to enablement of said multivibrator output or the presence of said second rectifier means potential.

8. The apparatus of claim 1, wherein said shunting means is a gateable, bidirectionally-conducting semiconducted switching device.

9. The apparatus of claim 8, wherein said device is a triac.

10. In combination, a plurality of the apparatus of claim 1, for forming current-carrying connections between a multi-phase A.C. source and a multi-phase current-consuming load; each of said plurality of apparatus being connected in series between one phase output of said source and one phase input of said load; and plurality of apparatus being connected to completely connect and disconnect said source to said load responsive to said control signal.

* * * * *